US009725851B2

(12) United States Patent
Scheffler

(10) Patent No.: US 9,725,851 B2
(45) Date of Patent: Aug. 8, 2017

(54) TRANSPORT DEVICE FOR PAPER, AND PAPER PROCESSING DEVICE

(71) Applicant: Jörg Scheffler, Karlsruhe (DE)

(72) Inventor: Jörg Scheffler, Karlsruhe (DE)

( * ) Notice: Subject to any disclaimer, the term of this patent is extended or adjusted under 35 U.S.C. 154(b) by 40 days.

(21) Appl. No.: 14/766,055

(22) PCT Filed: Feb. 7, 2014

(86) PCT No.: PCT/EP2014/000334
§ 371 (c)(1),
(2) Date: Aug. 5, 2015

(87) PCT Pub. No.: WO2014/121939
PCT Pub. Date: Aug. 14, 2014

(65) Prior Publication Data
US 2016/0032526 A1 Feb. 4, 2016

(30) Foreign Application Priority Data
Feb. 8, 2013 (DE) ..... 10 2013 002 122

(51) Int. Cl.
*D21F 2/00* (2006.01)
*B65H 5/22* (2006.01)
*B65H 19/26* (2006.01)

(52) U.S. Cl.
CPC ..... *D21F 2/00* (2013.01); *B65H 5/224* (2013.01); *B65H 2301/531* (2013.01); *B65H 2404/1151* (2013.01); *B65H 2404/271* (2013.01); *B65H 2404/28* (2013.01); *B65H 2404/561* (2013.01); *B65H 2406/20* (2013.01); *B65H 2406/32* (2013.01); *B65H 2601/26* (2013.01); *B65H 2601/521* (2013.01)

(58) Field of Classification Search
CPC ..... D21F 1/10; D21F 2/00; B65H 2404/271; B65H 5/224; B65H 2301/531; B65H 2401/141; B65H 2404/1151; B65H 2404/28; B65H 2404/281; B65H 2404/561; B65H 2406/20; B65H 2406/32; B65H 2601/26; B65H 2601/521; B65H 5/02; B65H 19/20; B65H 19/26; B65G 15/54; B65G 15/30; B65G 21/2036
See application file for complete search history.

(56) References Cited

U.S. PATENT DOCUMENTS 1,927,498 A * 9/1933 Hamilton ..... D21F 1/10 139/425 A
3,139,119 A * 6/1964 Buchanan ..... D21F 1/10 139/425 A (Continued)

FOREIGN PATENT DOCUMENTS

DE 4015210 A1 11/1990
DE 102011084258 A1 4/2012

(Continued)

*Primary Examiner* — Jose Fortuna
(74) *Attorney, Agent, or Firm* — Rabin & Berdo, P.C.

(57) ABSTRACT

Described is a transport device for paper which includes a metal conveyor belt through which air can flow and which is guided over at least two rollers, with the upper section of the belt forming the transport section and its lower section forming the returning section. A vacuum generator is arranged below the upper section. The conveyor belt is a metal mesh so as to be easy to produce and install.

17 Claims, 6 Drawing Sheets

(56) References Cited

Figures 1, 2, 3:
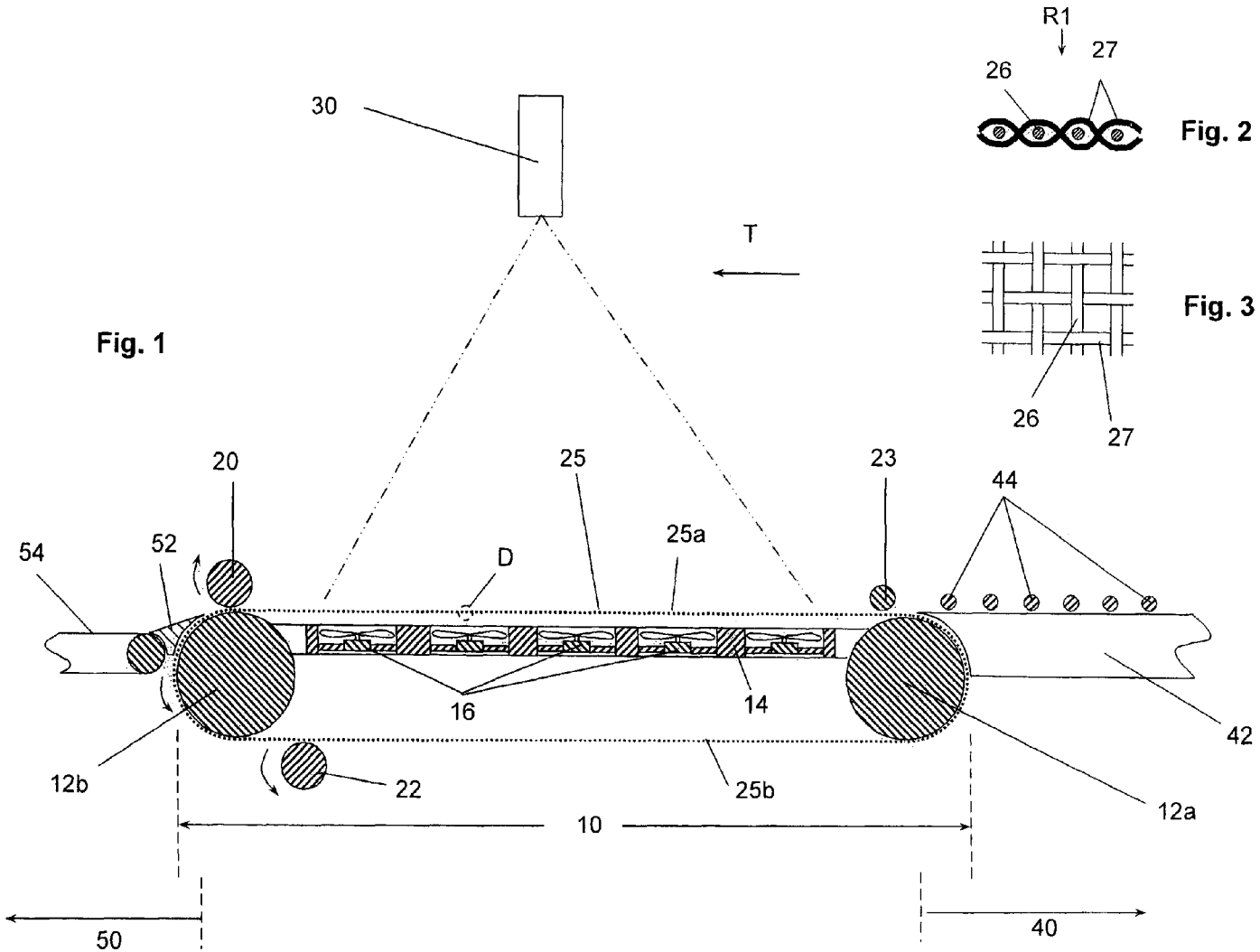

U.S. PATENT DOCUMENTS 3,143,150 A * 8/1964 Buchanan ..... D21F 1/10 139/383 A
3,177,113 A * 4/1965 Golden ..... D21F 1/10 139/425 A
3,309,265 A * 3/1967 Krake ..... D21F 1/0027 139/383 R
3,329,378 A * 7/1967 Stanton ..... D21F 1/10 139/425 A
3,346,465 A * 10/1967 Franck ..... C25D 7/0614 139/425 A
3,518,161 A * 6/1970 Ekberg ..... D21F 1/526 162/367
3,573,089 A * 3/1971 Tate ..... B01D 39/00 139/425 A
3,615,373 A * 10/1971 Bangert ..... C22C 9/02 139/425 A
4,860,883 A 8/1989 Knaul et al.
RE33,195 E * 4/1990 McDonald ..... D21F 1/0027 139/383 A
5,076,894 A 12/1991 Simmons et al.
5,121,170 A 6/1992 Bannai et al.
7,901,030 B2 * 3/2011 Miyata ..... B41J 11/007 347/103
8,585,866 B2 * 11/2013 Mikami ..... D21F 1/0063 162/202
9,334,122 B2 * 5/2016 Shoji ..... B65G 15/30
2002/0139264 A1 10/2002 Bartscher et al.
2004/0248721 A1 * 12/2004 Capdevilla ..... B60R 21/235 493/449
2008/0073838 A1 * 3/2008 Sakaida ..... B41J 11/007 271/276
2008/0107461 A1 * 5/2008 Miyata ..... B41J 11/007 399/343
2012/0085621 A1 * 4/2012 Bryl ..... B65G 45/22 198/494
2012/0085622 A1 4/2012 Bryl et al.
2013/0140143 A1 * 6/2013 De Bruijne ..... B23K 26/0838 198/689.1
2013/0319983 A1 * 12/2013 De Bruijne ..... B23K 26/0838 219/121.72
2014/0001014 A1 * 1/2014 Shoji ..... B65G 15/30 198/846
2015/0246776 A1 * 9/2015 Shoji ..... B65H 5/02 198/846
2016/0032526 A1 * 2/2016 Scheffler ..... B65H 5/224 162/286
2016/0236246 A1 * 8/2016 Kozuma ..... B41J 29/17

FOREIGN PATENT DOCUMENTS

EP 0454973 B1 5/1996
EP 1 918 115 A2 5/2008
WO WO 2004-037683 A2 5/2004
WO WO-2012/120606 A1 9/2012

* cited by examiner

TRANSPORT DEVICE FOR PAPER, AND PAPER PROCESSING DEVICE

TECHNICAL FIELD OF THE INVENTION

The invention relates to a transport device for paper as well as to a paper processing device.

PRIOR ART

According to the prior art, so-called suction belts are known for moving paper elements that must be precisely positioned. Suction belts of this type generally are made of rubber or a similar material and are provided with a multitude of holes. The transport device comprises at least two rollers over which this suction belt moves, while a so-called suction box that can be subjected to a vacuum or low pressure is installed below the upper section of this suction belt which functions as conveyor belt (meaning below the transport section of the conveyor belt). The top surface of the suction box contains numerous openings, so that the vacuum effective in the suction box on the one hand pulls the transport section against the suction box and, on the other hand, pulls the paper located on the surface of the transport section against this surface.

Laser cutting systems are furthermore known in the art which can be used to cut extremely precise contours from paper, for example to create letters, numbers or other symbols in the form of cutouts. Of course, with these systems the paper must also be placed and/or transported precisely positioned, relative to the laser, so that the use of corresponding suction belts make sense as well. As a result of the high thermal stresses caused by the laser, however, the use of conventional suction belts, in particular those made of rubber or a rubber-type material, is not possible and/or would result in extremely high wear. The use of a thin sheet metal strip for the conveyor belt is known for laser cutting systems of this type. This sheet metal is provided with an extremely high number of small, laser-cut holes prior to the ends being welded together to form a continuous belt, so that this metal belt can be guided in the conventional manner over a suction box. The disadvantages of such a metal belt are the extremely high costs for producing and installing it.

SUBJECT MATTER OF THE INVENTION

Starting therefrom, it is the object of the present invention to further improve a generic transport device which can also be used at permanently high or occasionally high temperatures and which is noticeably easier to produce and preferably also easier to install.

This object is solved with a transport device having the features as disclosed below.

The conveyor belt according to the invention is also composed of metal. However, it does not consist of a metal sheet with holes, but of a metal mesh. Metal meshes of this type are produced for different purposes in large amounts and at very reasonable cost. It has turned out that a metal mesh of this type serves the same purpose over a wide range of mesh widths and wire strengths as the above-mentioned metal belt with laser-cut holes. It has furthermore turned out that metal meshes of this type can be easily welded together to form continuous belts, using the plasma or laser welding technique, and are extremely suitable for use as continuous conveying belts because of their mechanical features (in particular the tensile strain). Another advantage is that compared to the standard metal belts with laser-cut holes, they can be cleaned easier in many cases. This is important for the above-described and presently preferred area of use in laser cutting systems (claim 16) since burning residues from the paper (ash and the like) remain on the conveyor belt as a result of the laser cutting and preferably should be removed constantly during the continuous operation.

A further advantage is that the metal mesh scatters rather than reflects the laser light, which greatly reduces the negative influences of the reflections. The undesirable reflections can be reduced even more with the aid of sand blasting and/or by Nano coating of the metal mesh.

Additional advantages and preferred embodiments of the invention follow from the exemplary embodiments which are explained further with reference to the Figures.

SHORT DESCRIPTION OF THE DRAWINGS

Figure 4:
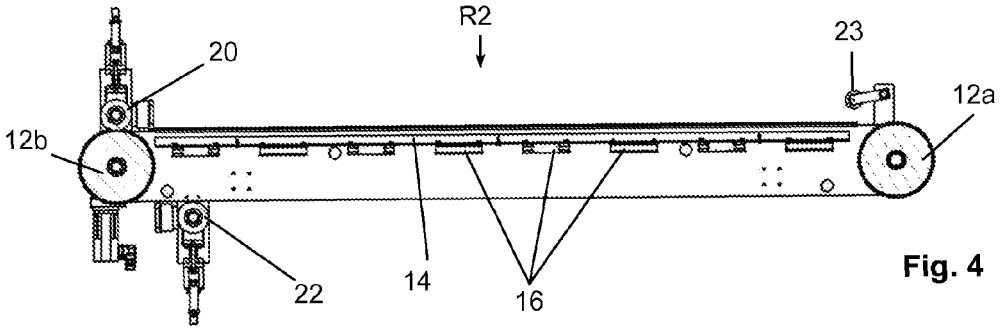
Figure 5:
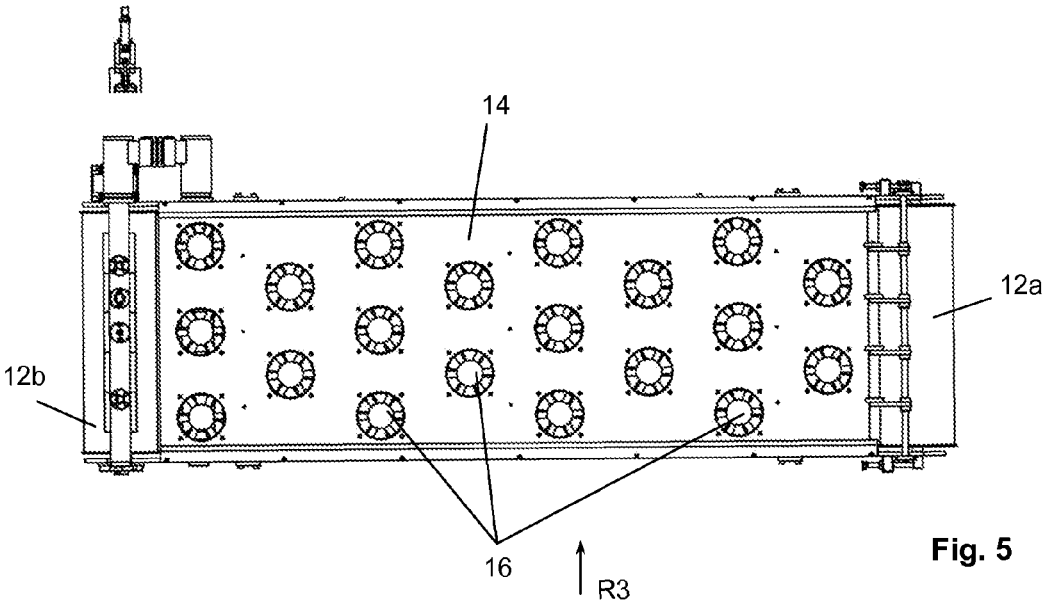
Figure 6:
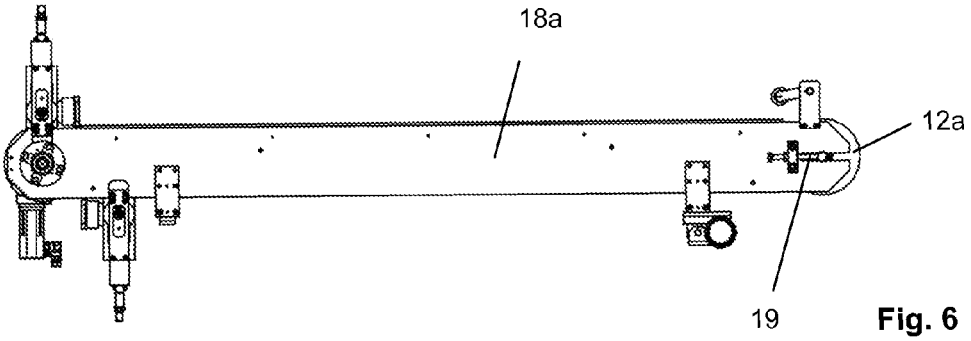
Figure 7:
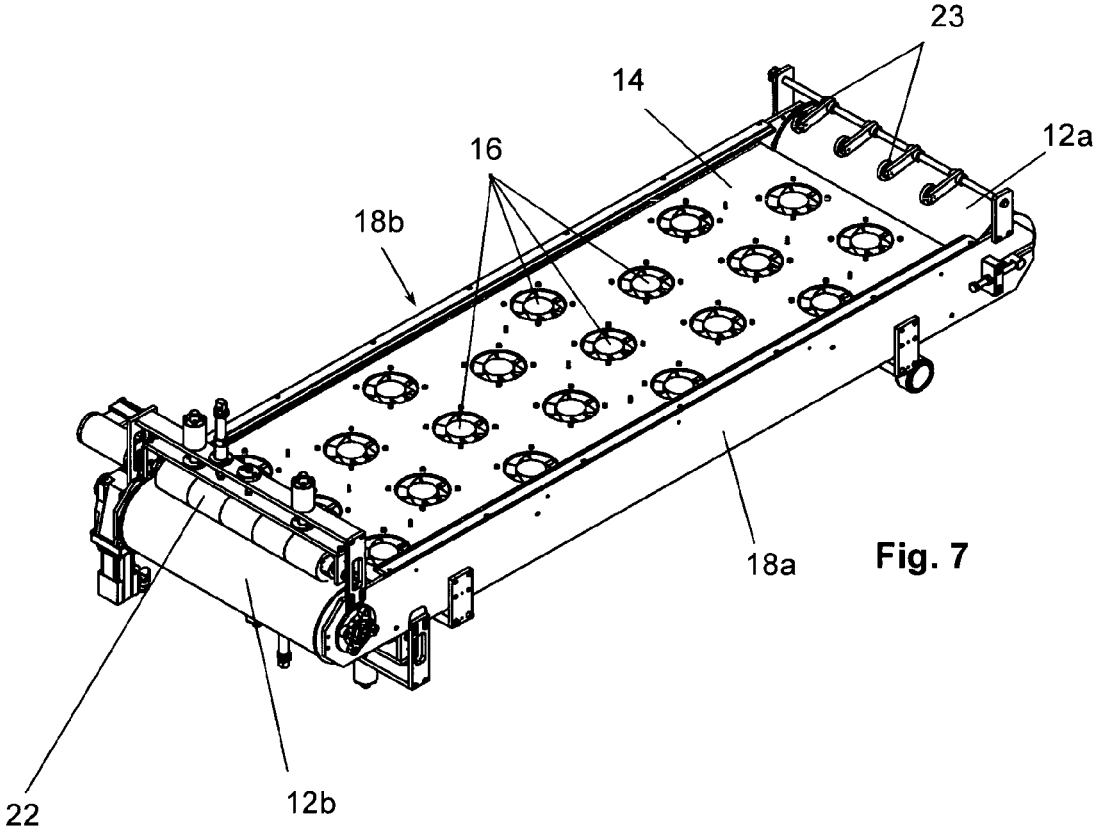
Figure 8:
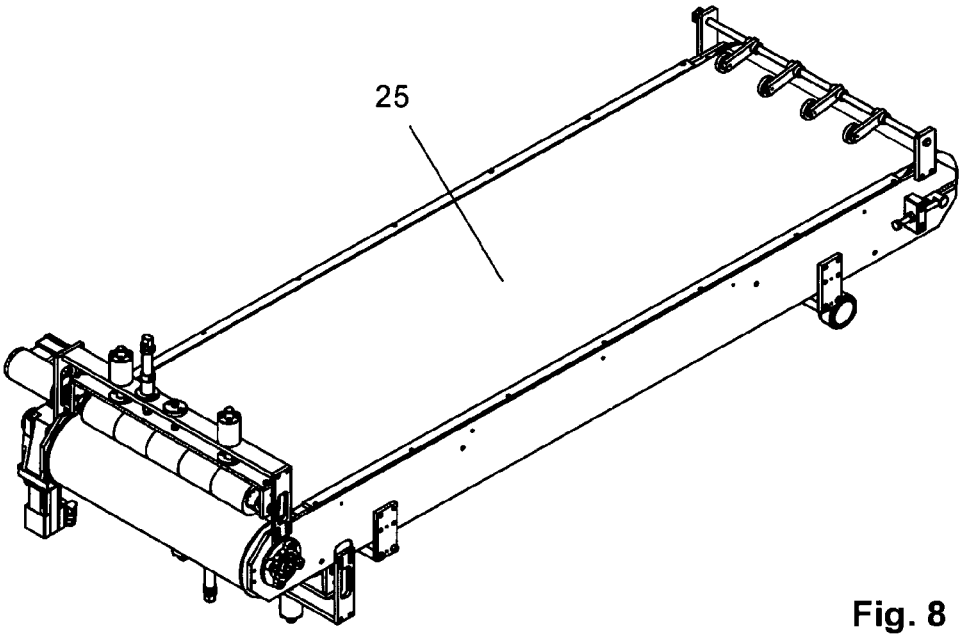
Figure 9:
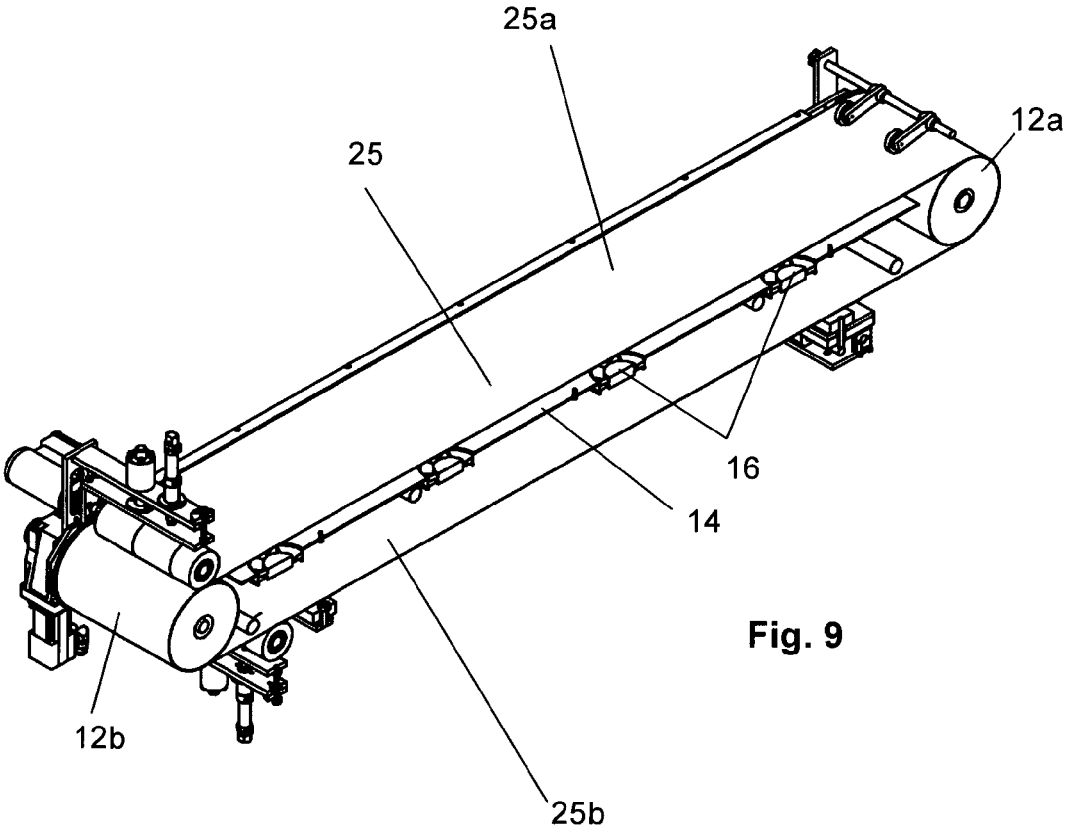
Figure 10:
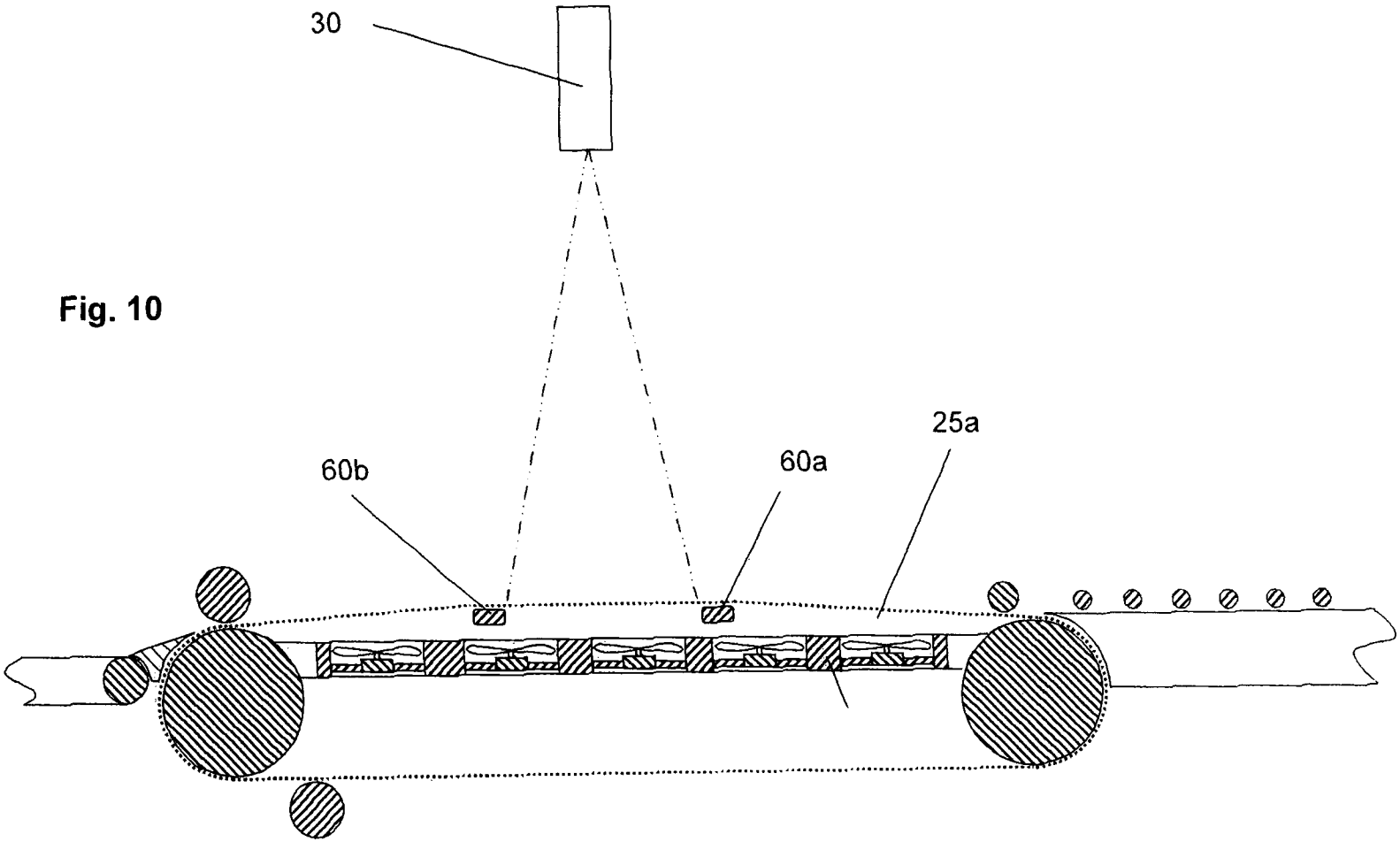
Figure 11:
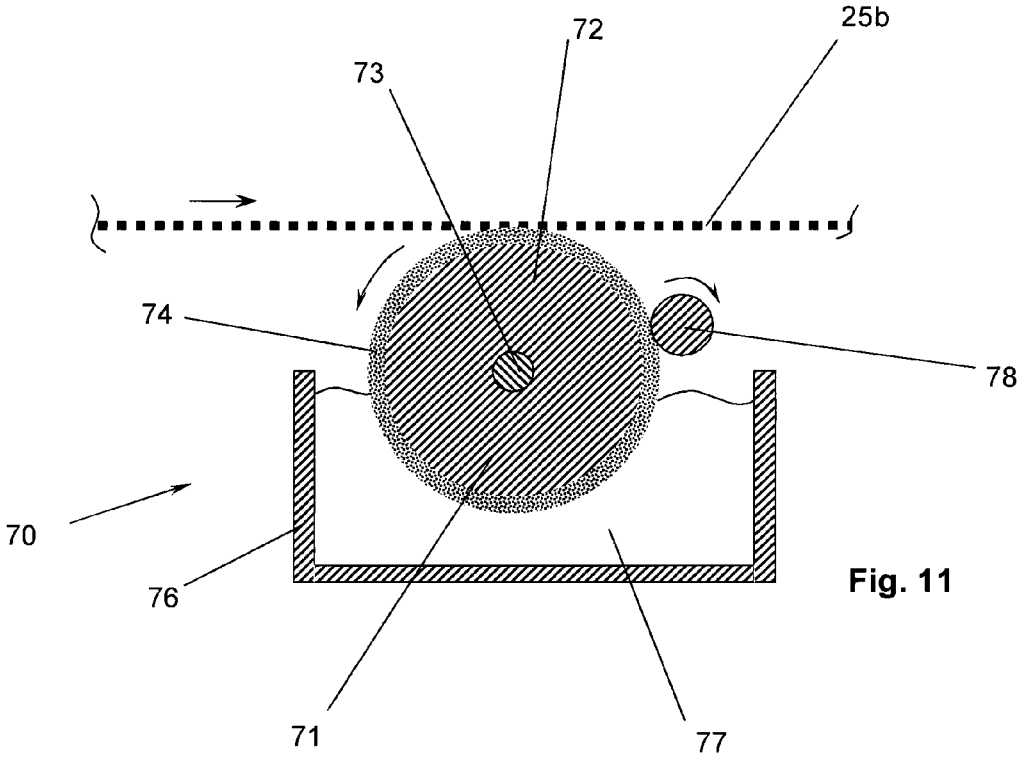

Shown are in:

FIG. 1 A strongly schematic cross sectional view through a laser cutting system, using a transport device according to the invention;

FIG. 2 The detail D from FIG. 1, also shown in a strongly schematic sectional view which is not true to scale;

FIG. 3 A plan view from the direction R1 onto the representation in FIG. 2;

FIG. 4 The transport device shown in FIG. 1, in a somewhat more detailed representation, wherein the conveyor belt is not shown;

FIG. 5 A plan view from the direction R2 in FIG. 4;

FIG. 6 A plan view from the direction R3 in FIG. 5;

FIG. 7 A perspective view of the representation shown in FIGS. 4 to 6;

FIG. 8 The representation shown in FIG. 7 with the conveyor belt installed;

FIG. 9 The representation shown in FIG. 8, showing a cut-open view;

FIG. 10 A variation of the view of what is shown in FIG. 1;

FIG. 11 A preferred embodiment of a cleaning station; and

Figure 12:
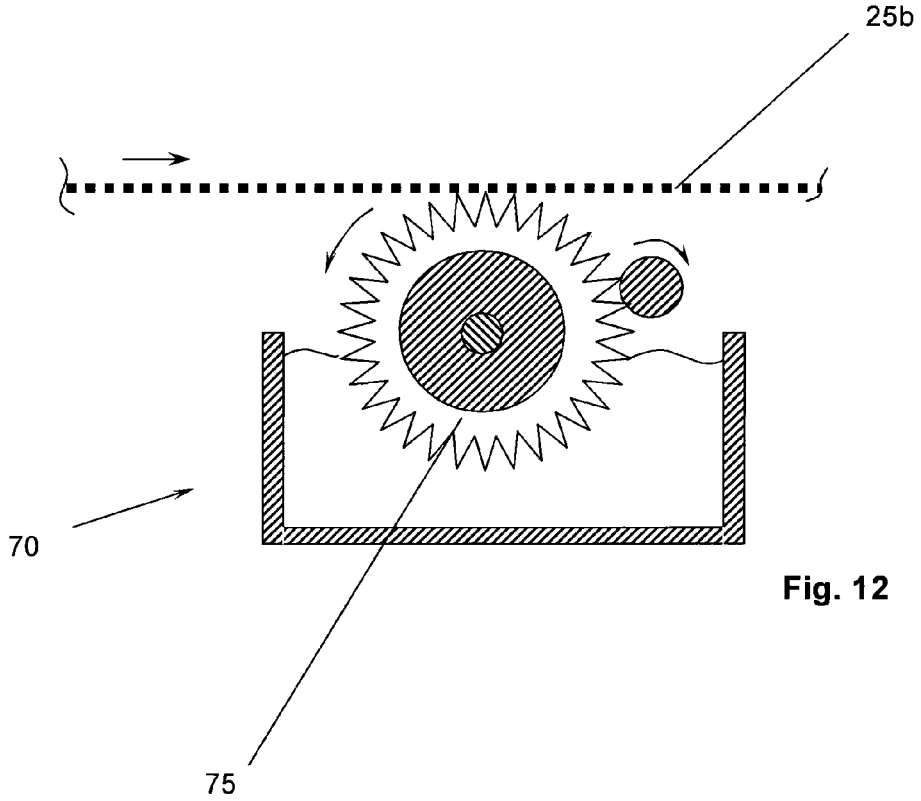

FIG. 12 A variation of the view of what is shown in FIG. 11.

DESCRIPTION OF THE PREFERRED EMBODIMENTS

FIG. 1 schematically shows a cross-sectional view of a device for producing laser cuts in flat paper blanks, such as greeting cards or the like. This device comprises four elements, namely a feed unit 40, a transport device 10, a laser 30 arranged above the transport device and a removal unit 50. The paper is transported in the direction T, and the device can operate continuously, meaning the laser generates the cutout contours during a continuous transport movement of the transport device 10.

The feed unit 40 can have a standard configuration, namely consisting of a table 42 with smooth surface and a number of transport rolls 44 which supply the paper blanks with a sliding movement across the table to the transport device 10. The angle of the transport rolls 44 can deviate slightly from a 90 degree angle, relative to the transport direction T (see FIG. 1) and can press the paper blanks in such a way against an end stop that a more precise positioning of the paper blanks is achieved. The removal unit 50 can also have a standard configuration and, for example, can consist of a connecting piece 52 and a conveying belt 54. However, it would also be possible to provide a stacker or the like immediately downstream of the transport device 10.

The essential elements of the transport device 10 according to the invention are two rollers 12*a*, 12*b*, wherein at least one of the two rollers is driven, the rear roller 12*b* in this case, the conveyor belt 25, as well as a plurality of axial fans 16 which are arranged below the upper section (meaning the transport section) 25*a* of the conveyor belt 25. A support 14 that is positioned in the horizontal plane and essentially extends from the front roller 12*a* to the rear roller 12*b* serves to position these axial fans 16 (the axial fans 16 in principle can be designed in the same way as conventional fans used in computer casings). The support 14 is provided with a plurality of openings. The axial fans 16 are arranged at these openings, as shown only very schematically in FIG. 1. In praxis, the support 14 can also be embodied considerably thinner (as shown in the following with reference to FIGS. 4 to 9). The axial fans 16 are preferably positioned relatively close to the underside of the upper section 25*a* of the conveyor belt.

The conveyor belt 25 according to the invention consists of a metal mesh, generally a mesh composed of warp wires 27 and weft wires 26, as shown schematically in FIGS. 2 and 3. The wire thickness of the woven wires advantageously ranges from 0.25 to 0.4 mm and the mesh width is preferably between 0.4 and 0.6 mm. Stainless steel or high-grade steel is advantageously used for the metal mesh, for example V2A. A so-called "normal wire mesh" is preferably used, meaning a wire mesh in smooth weave, a wire mesh in plain weave, or a wire mesh in twill weave. If a wire mesh in twill weave is used, the warp wires 27 preferably extend in transport direction. To produce the conveyor belt, a piece of metal mesh having the required length and width is cut and the edges of the two ends (as a rule the short edges) are welded together, preferably with the aid of plasma welding or laser welding, so that an endless conveyor belt is created.

The transport device 10 can optionally also comprise the following elements shown herein: intake or feed rollers 23, a delivery roller 20 and a lower cleaning brush 22 or a cleaning station. A preferred embodiment of such a cleaning station is explained later on with reference to FIGS. 11 and 12, wherein the delivery roller 20 can also have a cleaning function in this case. Providing at least one cleaning roller or cleaning brush is preferred for the described use of the transport device since the burning residues generally must be removed from the transport device 10. Insofar as a delivery roller 20 is provided as shown at the end of the upper section 25*a* of the conveyor belt 25 (meaning the transport section), it must be driven counter to the rollers 12*a, b*. A cleaning brush 22 or a cleaning roller acting upon the lower, meaning the returning section, of the conveyor belt can also be driven in the same direction as the rollers 12*a*, b, meaning in the direction counter to the lower section 25*b*, which can result in improving the cleaning effect. Since the delivery roller 20 also acts upon the paper blanks to be processed, it must be made of a relatively soft material, while the lower cleaning brush 22 can consist of a relatively hard material. The lower cleaning brush 22 could, of course, also act upon the conveyor belt 25 in the region of one of the two rollers (respectively already in the lower half).

It has furthermore proven extremely advantageous to clean the lower section 25*b* with a "chainsaw-type" cleaning device for which the movement direction is perpendicular to the transporting direction. With a cleaning device of this type, the cleaning brushes circulate in the manner of a chainsaw between two rollers. In the effective section, the cleaning brushes move along a straight line.

For most application cases, a slightly wet cleaning is preferable.

The cutting laser 30 is arranged above the transport device 10.

The device preferably operates continuously, as previously mentioned, and at a constant transporting speed. As a result of the axial fans 16, which suction in air through the upper section 25*a* of the conveyor belt 25, the paper blanks which are supplied by the feed unit 40 in a precise position are held in this position. The air ejected by the axial fans 16 exits through the lower section 25*b* of the conveyor belt and thus also contributes to a cleaning of the returning section of the conveyor belt 25. Providing axial fans instead of a suction box furthermore has the additional great advantages of requiring considerably less energy and resulting in a noticeably lower noise development (traditional suction boxes generally use radial compressors for the vacuum generators).

The laser 30 cuts the paper blanks, positioned on the upper section of the conveyor belt, which then leave the transport device 10 at the rear roller 12*b* and are discharged via the discharge unit 50.

FIGS. 4 to 9 show the above-described transport device 10 once more with further details, wherein the conveyor belt 25 is not shown in FIGS. 4 to 7. All elements are provided with references to match those in FIG. 1, so as to avoid repetitions if possible. It is easy to see in FIGS. 4 and 9 that the horizontally extending support 14 can be embodied pretty thin and that the drive motors for the axial fans 16 can be positioned outside of the plane defined by the support 14. The diameters for the openings in the support 14 substantially correspond to the diameters of the vanes on the axial fans that are used. In particular in FIG. 6, it is obvious that the support 14 extends between two side faces 18*a*, 18*b*, (not shown) so that the two sections of the conveyor belt 25, the rollers 12*a*, 12*b* and the side faces 18*a*, 18*b* enclose an inside area in which the aforementioned support 14 is arranged.

To be able to tension the conveyor belt 25, at least one end of each side face comprises a slot 19 that extends in transport direction and through which the axis of a roller—in this case the front roller 12*a*—extends, so that the distance between the rollers 12*a*, 12*b* can be changed and the conveyor belt 25 can thus be tensioned. The conveyor belt 25 can therefore also be installed in the fully assembled state, meaning in the state where it is welded together to form an endless loop, wherein it is fitted on by pushing it from the side onto the rollers 12*a*, 12*b*. For this, additional units such as the intake rollers 23 and the like may have to be dismantled if applicable.

To achieve a further improvement in the flatness of the transported paper in a central segment of the upper section 25*a* of the conveyor belt 25, it is possible to provide two crossbars 60*a*, 60*b* that extend crosswise to the transporting direction, the upper points of which are located above the upper points of the rollers 12*a*, 12*b*, so that a slightly higher and extremely flat central segment is formed, as shown schematically in FIG. 10.

FIGS. 11 and 12 show a preferred embodiment of a cleaning station 70 which can be arranged below the return section 25*b* of the conveyor belt 25, for example at the location of the above-mentioned cleaning brush 22. This cleaning station 70 comprises a cleaning roller 71, driven around an axis 73, and a container 76 that is open on the top for holding cleaning liquid 77 (water in the simplest case). A strip roller 78 is preferably also provided, which is driven in the opposite direction as the cleaning roller. At least the shell of the cleaning roller 71 is embodied as a sponge (sponge shell 74—FIG. 11) or in the form of a brush (brush shell 75—FIG. 12). The cleaning roller 71 is advantageously driven to rotate in the same direction as the rollers 12*a*, 12*b*.

The cleaning roller 71 is positioned such that it presses from below against the return section 25*b* of the conveyor belt 25 while a lower portion of this roller is submerged in the cleaning fluid 77. As a result of the rotation of the cleaning roller, new cleaning fluid 77 is constantly absorbed and conveyed to the return section 25*b* of the conveyor belt. The degree of moistening of the return section can be adjusted with the strip roller which is arranged in rotational direction of the cleaning roller between the cleaning fluid and the conveyor belt. It is preferable in that case if the radial distance between the cleaning roller and the strip roller 78 is adjustable.

The moist or wet cleaning (in particular with the aid of the above-described cleaning station) has several advantages. Above all, it is possible to achieve a good cleaning of the conveyor belt to remove burning residue, ash and the like. The moistening of the conveyor belt as such furthermore also has advantages. On the one hand, it generates cold by evaporation—which is additionally helped by the arrangement of the axial fans—meaning it results in a cooling of the conveyor belt, the upper section 25*a* of which is admitted with laser energy. The degree of moistening can furthermore be adjusted, such that a certain amount of liquid still adheres to the upper section 25*a* of the conveyor belt. This remaining liquid improves the adhesion of burn residue, ash and the like, thereby preventing these residues from dirtying the back side of the paper to be processed. The mesh structure of the metal conveyor belt strongly favors the desired adherence of liquid.

A further option for using the conveyor belt according to the invention is for drying sections for drying paper, in particular paper imprinted by an inkjet printer.

The invention claimed is:

1. A paper processing arrangement comprising:

a transport device for transporting paper, including:

two rollers;

a conveyor belt that is guided over the two rollers and is composed of metal mesh through which air can flow, the belt having an upper section forming a transport section, and a lower section forming a return section and connected with the upper section;

one of a vacuum generator and a low pressure generator, the one of the vacuum generator and the low pressure generator being arranged below the upper section; and at least one cleaning device which acts upon the return section, the cleaning device moistening the conveyor belt so that both the upper and lower sections are moist; and a laser, arranged above the transport section, for cutting paper on the moistened upper section.

2. The paper processing arrangement according to claim 1, wherein the conveyor belt is produced from a metal-mesh strip, end faces of which are plasma-welded together or laser welded together.

3. The paper processing arrangement according to claim 2, wherein the one of the vacuum generator and the low pressure generator is the vacuum generator, wherein the vacuum generator comprises at least one axial fan, arranged between the transport and the return sections.

4. The paper processing arrangement according to claim 3, wherein the vacuum generator comprises several axial fans.

5. The paper processing arrangement according to claim 2, wherein the metal mesh is a mesh in twill weave, a mesh in plain weave or a mesh in smooth weave.

6. The paper processing arrangement according to claim 1, wherein, the one of the vacuum generator and the low pressure generator is the vacuum generator, the vacuum generator comprises at least one axial fan, arranged between the transport section and the return section.

7. The paper processing arrangement according to claim 6, wherein the axial fan acts directly onto the transport section and the return section.

8. The paper processing arrangement according to claim 7, wherein the vacuum generator comprises several axial fans.

9. The paper processing arrangement according to claim 6, wherein the vacuum generator comprises a plurality of axial fans.

10. The paper processing arrangement according to claim 1, wherein the mesh of the metal mesh is a mesh a twill weave, a mesh in plain weave or a mesh in smooth weave.

11. The paper processing arrangement according to claim 1, wherein the cleaning device is a cleaning station, including a cleaning roller that can be driven, and a container that is open on a top and can be filled with liquid, wherein the cleaning roller is positioned such that an upper section of a surface of the cleaning roller comes in contact with the return section of the conveyor belt and that a lower section of the cleaning roller is located inside the container.

12. The paper processing arrangement according to claim 11, wherein an axis of the cleaning roller extends parallel to axes of the two rollers.

13. The paper processing arrangement according to claim 12, wherein the cleaning roller is driven in a same rotational direction as that of the two rollers.

14. The paper processing arrangement according to claim 11, wherein the transport device further comprises a strip roller extending parallel to the cleaning roller and driven in a counter direction counter to that of the cleaning roller, the strip roller coming into contact with a section of the surface of the cleaning roller.

15. The paper processing arrangement according to claim 11, wherein at least an outer jacket of the cleaning roller is a sponge.

16. The paper processing arrangement according to claim 11, wherein at least an outer jacket of the cleaning roller is a brush having bristles extending essentially radially to an axis of the cleaning roller.

17. The paper processing arrangement according to claim 1, wherein the conveyor belt is sand blasted and/or is coated with a Nano coating.

* * * * *